US006718896B2

(12) United States Patent
Davenport

(10) Patent No.: US 6,718,896 B2
(45) Date of Patent: Apr. 13, 2004

(54) FABRIC STRUCTURE FOR A FLEXIBLE FLUID CONTAINMENT VESSEL

(75) Inventor: Francis L. Davenport, Ballston Lake, NY (US)

(73) Assignee: Albany International Corp., Albany, NY (US)

( * ) Notice: Subject to any disclaimer, the term of this patent is extended or adjusted under 35 U.S.C. 154(b) by 17 days.

(21) Appl. No.: 10/020,485

(22) Filed: Oct. 30, 2001

(65) Prior Publication Data

US 2003/0079667 A1 May 1, 2003

(51) Int. Cl.[7] ..... B63B 25/08
(52) U.S. Cl. ..... 114/74 T
(58) Field of Search ..... 114/256, 74 T, 114/74 R

(56) References Cited

U.S. PATENT DOCUMENTS

| | | | |
|---|---|---|---|
| 34,426 | A | 2/1862 | Howard |
| 389,615 | A | 9/1888 | Townsend |
| 1,723,307 | A | 8/1929 | Sipe |
| 1,921,015 | A | 8/1933 | Young |

(List continued on next page.)

FOREIGN PATENT DOCUMENTS

| | | | |
|---|---|---|---|
| DE | 198 21 465 | A | 11/1999 |
| EP | 0 134 706 | A | 3/1985 |
| EP | 0 710 736 | A1 | 11/1994 |
| EP | 0 687 625 | | 12/1995 |

(List continued on next page.)

OTHER PUBLICATIONS

International Search Report issued by the European Patent Office on Feb. 6, 2003 for PCT/US02/34299.
International Search Report issued by the European Patent Office on Feb. 10, 2003 for PCT/US02/34052.
International Search Report issued by the European Patent Office on Mar. 12, 2003 for PCT/US02/34004.
*McGraw–Hill Encyclopedia of Science and Technology, 6th Edition*, 1987, McGraw–Hill Book Company, New York XP00220369918, pp. 247–248 Paragraph 4; figures 6–8.
"3–D Braided Composites—Design and Applications" by D. Brookstein, 6th European Conference on Composite Materials, Sep. 1993, pp. 225–230.
Pages from web site of Bradlye Textiles, Inc.
International Search Report issued by European Patent Office on Jul. 9, 2002 for PCT/US02/10694 filed Apr. 5, 2002.

*Primary Examiner*—Ed Swinehart
(74) *Attorney, Agent, or Firm*—Frommer Lawrence & Haug LLP; Ronald R. Santucci

(57) ABSTRACT

A flexible fluid containment vessel or vessels for transporting and containing a large volume of fluid, particularly fresh water which is fabricated out of a fabric made out of a plurality of separately formed layers which are bound together.

16 Claims, 2 Drawing Sheets

U.S. PATENT DOCUMENTS

| | | | |
|---|---|---|---|
| 2,065,480 | A | 12/1936 | Soper |
| 2,371,404 | A | 3/1945 | Mumford |
| 2,391,926 | A | 1/1946 | Scott |
| 2,492,699 | A | 12/1949 | Houwink |
| 2,685,964 | A | 8/1954 | Brown |
| 2,724,358 | A | 11/1955 | Harris et al. |
| 2,725,027 | A | 11/1955 | Brandon et al. |
| 2,794,192 | A | 6/1957 | Paris |
| 2,854,049 | A | 9/1958 | Wyllie |
| 2,968,272 | A | 1/1961 | Berglund |
| 2,979,008 | A | 4/1961 | Whipple |
| 2,997,973 | A | 8/1961 | Hawthorne et al. |
| 2,998,793 | A | 9/1961 | Hawthorne et al. |
| 3,001,501 | A | 9/1961 | Hawhtorne et al. |
| 3,018,748 | A | 1/1962 | Denis et al. |
| 3,056,373 | A | 10/1962 | Hawthorne et al. |
| 3,067,712 | A | 12/1962 | Koerpinghaus |
| 3,150,627 | A | 9/1964 | Stewart et al. |
| 3,167,103 | A | 1/1965 | Hawthorne et al. |
| 3,224,403 | A | 12/1965 | Paddington |
| 3,282,361 | A | 11/1966 | Mackie |
| 3,289,721 | A | 12/1966 | Benson |
| 3,296,994 | A | 1/1967 | Schirtzinger |
| 3,502,046 | A | 3/1970 | Stauber |
| 3,622,437 | A | 11/1971 | Hobaica et al. |
| 3,661,693 | A | 5/1972 | Pierson |
| 3,672,319 | A | 6/1972 | Platzer |
| 3,739,410 | A | 6/1973 | Fortin |
| 3,762,108 | A | 10/1973 | Pierson |
| 3,774,563 | A | 11/1973 | Anderson, Sr. et al. |
| 3,779,196 | A | 12/1973 | Knaus et al. |
| 3,797,445 | A | 3/1974 | Zeimer |
| 3,812,805 | A | 5/1974 | Forssell et al. |
| 3,839,977 | A | 10/1974 | Bradberry |
| 3,952,679 | A | 4/1976 | Grihangne |
| 3,955,524 | A | 5/1976 | Renoux |
| 3,974,789 | A | 8/1976 | DeGroot |
| 4,108,101 | A | 8/1978 | Schirtzinger |
| 4,227,474 | A | 10/1980 | Ullrich |
| 4,227,477 | A | 10/1980 | Preus |
| 4,227,478 | A | 10/1980 | Preus |
| 4,230,061 | A | 10/1980 | Roberts |
| 4,373,462 | A | 2/1983 | Fish |
| 4,399,765 | A | 8/1983 | Alkner et al. |
| 4,506,623 | A | 3/1985 | Roper et al. |
| 4,509,558 | A | 4/1985 | Slater |
| 4,510,201 | A | 4/1985 | Takeuchi et al. |
| 4,582,756 | A | 4/1986 | Niinuma et al. |
| 4,641,400 | A | 2/1987 | Moreland |
| 4,662,386 | A | 5/1987 | Pedersen |
| 4,726,986 | A | 2/1988 | Cannady, Jr. et al. |
| 4,910,817 | A | 3/1990 | Tetsuo |
| 4,933,231 | A | 6/1990 | Seber |
| 4,948,658 | A | 8/1990 | Halker |
| 4,998,498 | A | 3/1991 | Gallichan |
| 5,082,726 | A | 1/1992 | Bastiaens et al. |
| 5,194,459 | A | 3/1993 | Sato et al. |
| 5,203,272 | A | 4/1993 | Kassinger et al. |
| 5,235,928 | A | 8/1993 | Shank, Jr. |
| 5,238,537 | A | 8/1993 | Dutt |
| 5,243,925 | A | 9/1993 | Fortenberry |
| 5,262,230 | A | 11/1993 | Becker et al. |
| 5,355,819 | A | 10/1994 | Hsia et al. |
| 5,360,656 | A | 11/1994 | Rexfelt et al. |
| 5,391,424 | A | 2/1995 | Kolzer |
| 5,413,065 | A | 5/1995 | Spragg et al. |
| 5,421,128 | A | 6/1995 | Sharpless et al. |
| 5,431,970 | A | 7/1995 | Broun et al. |
| 5,482,763 | A | 1/1996 | Shaffer |
| 5,488,921 | A | 2/1996 | Spragg |
| 5,503,291 | A | 4/1996 | Craig |
| 5,505,557 | A | 4/1996 | Bradley |
| 5,544,612 | A | 8/1996 | Eymard |
| 5,657,714 | A | 8/1997 | Hsia et al. |
| 5,691,390 | A | 11/1997 | Harrison et al. |
| 5,713,399 | A | 2/1998 | Collette et al. |
| 5,735,083 | A | 4/1998 | Brown et al. |
| 5,780,144 | A | 7/1998 | Bradley |
| 5,790,304 | A | 8/1998 | Sanders et al. |
| 5,865,045 | A | 2/1999 | Wagner et al. |
| 5,902,070 | A | 5/1999 | Bradley |
| 5,921,421 | A | 7/1999 | Fuquan |
| 5,951,345 | A | 9/1999 | Perratone et al. |
| 6,003,565 | A | 12/1999 | Whittier, II et al. |
| 6,047,655 | A | 4/2000 | Cran |
| 6,056,438 | A | 5/2000 | Bradley |
| 6,086,968 | A | 7/2000 | Horovitz |
| 6,101,964 | A | 8/2000 | Lesesne |
| 6,290,818 | B1 | 9/2001 | Romanski |
| 6,474,022 | B1 | 11/2002 | Double et al. |
| 6,550,410 | B2 | 4/2003 | Reimers |

FOREIGN PATENT DOCUMENTS

| | | | |
|---|---|---|---|
| EP | 0 862 870 | A | 9/1998 |
| EP | 0 832 032 | B1 | 4/1999 |
| FR | 2 325 837 | | 4/1977 |
| FR | 2595621 | | 9/1987 |
| GB | 824 984 | A | 12/1959 |
| GB | 826 301 | A | 12/1959 |
| GB | 907 266 | | 10/1962 |
| GB | 933 889 | A | 8/1963 |
| GB | 1 079 766 | | 8/1967 |
| GB | 1117552 | | 6/1968 |
| GB | 1117553 | | 6/1968 |
| JP | 60 219243 | A | 11/1985 |
| WO | WO 97/14622 | A | 4/1997 |
| WO | WO 97/49541 | | 12/1997 |
| WO | WO 98/01359 | A | 1/1998 |
| WO | WO 01 63033 | | 8/2001 |

FABRIC STRUCTURE FOR A FLEXIBLE FLUID CONTAINMENT VESSEL

FIELD OF THE INVENTION

The present invention relates to a flexible fluid containment vessel (sometimes hereinafter referred to as "FFCV") for transporting and containing a large volume of fluid, particularly fluid having a density less than that of salt water, more particularly, fresh water, and the method of making the same.

BACKGROUND OF THE INVENTION

The use of flexible containers for the containment and transportation of cargo, particularly fluid or liquid cargo, is well known. It is well known to use containers to transport fluids in water, particularly, salt water.

If the cargo is fluid or a fluidized solid that has a density less than salt water, there is no need to use rigid bulk barges, tankers or containment vessels. Rather, flexible containment vessels may be used and towed or pushed from one location to another. Such flexible vessels have obvious advantages over rigid vessels. Moreover, flexible vessels, if constructed appropriately, allow themselves to be rolled up or folded after the cargo has been removed and stored for a return trip.

Throughout the world there are many areas which are in critical need of fresh water. Fresh water is such a commodity that harvesting of the ice cap and icebergs is rapidly emerging as a large business. However, wherever the fresh water is obtained, economical transportation thereof to the intended destination is a concern.

For example, currently an icecap harvester intends to use tankers having 150,000 ton capacity to transport fresh water. Obviously, this involves, not only the cost in using such a transport vehicle, but the added expense of its return trip, unloaded, to pick up fresh cargo. Flexible container vessels, when emptied can be collapsed and stored on, for example, the tugboat that pulled it to the unloading point, reducing the expense in this regard.

Even with such an advantage, economy dictates that the volume being transported in the flexible container vessel be sufficient to overcome the expense of transportation. Accordingly, larger and larger flexible containers are being developed. However, technical problems with regard to such containers persist even though developments over the years have occurred. In this regard, improvements in flexible containment vessels or barges have been taught in U.S. Pat. Nos. 2,997,973; 2,998,973; 3,001,501; 3,056,373; and 3,167,103. The intended uses for flexible containment vessels is usually for transporting or storing liquids or fluidisable solids which have a specific gravity less than that of salt water.

The density of salt water as compared to the density of the liquid or fluidisable solids reflects the fact that the cargo provides buoyancy for the flexible transport bag when a partially or completely filled bag is placed and towed in salt water. This buoyancy of the cargo provides flotation for the container and facilitates the shipment of the cargo from one seaport to another.

In U.S. Pat. No. 2,997,973, there is disclosed a vessel comprising a closed tube of flexible material, such as a natural or synthetic rubber impregnated fabric, which has a streamlined nose adapted to be connected to towing means, and one or more pipes communicating with the interior of the vessel such as to permit filling and emptying of the vessel. The buoyancy is supplied by the liquid contents of the vessel and its shape depends on the degree to which it is filled. This patent goes on to suggest that the flexible transport bag can be made from a single fabric woven as a tube. It does not teach, however, how this would be accomplished with a tube of such magnitude. Apparently, such a structure would deal with the problem of seams. Seams are commonly found in commercial flexible transport bags, since the bags are typically made in a patch work manner with stitching or other means of connecting the patches of water proof material together. See e.g. U.S. Pat. No. 3,779,196. Seams are, however, known to be a source of bag failure when the bag is repeatedly subjected to high loads. Seam failure can obviously be avoided in a seamless structure. However, since a seamed structure is an alternative to a simple woven fabric and would have different advantages thereto, particularly in the fabrication thereof, it would be desirable if one could create a seamed tube that was not prone to failure at the seams.

In this regard, U.S. Pat. No. 5,360,656 entitled "Press Felt and Method of Manufacture", which issued Nov. 1, 1994 and is commonly assigned, the disclosure of which is incorporated by reference herein, discloses a base fabric of a press felt that is fabricated from spirally wound fabric strips. The fabric strip of yarn material, preferably being a flat-woven fabric strip, has longitudinal threads which in the final base fabric make an angle in what would be the machine direction of the press felt.

During the manufacture of the base fabric, the fabric strip of yarn material is wound or placed spirally, preferably over at least two rolls having parallel axes. Thus, the length of fabric will be determined by the length of each spiral turn of the fabric strip of yarn material and its width determined by the number of spiral turns.

The number of spiral turns over the total width of the base fabric may vary. The adjoining portions of the longitudinal edges of the spirally-wound fabric strip are so arranged that the joints or transitions between the spiral turns can be joined in a number of ways.

An edge joint can be achieved, e.g. by sewing, melting, and welding (for instance, ultrasonic welding as set forth in U.S. Pat. No. 5,713,399 entitled "Ultrasonic Seaming of Abutting Strips for Paper Machine Clothing" which issued Feb. 3, 1998 and is commonly assigned, the disclosure of which is incorporated herein by reference) of material or of non-woven material with melting fibers. The edge joint can also be obtained by providing the fabric strip of yarn material along its two longitudinal edges with seam loops of a known type, which can be joined by means of one or more seam threads. Such seam loops may for instance be formed directly of the weft threads, if the fabric strip is flat-woven.

While that patent relates to creating a base fabric for a press felt such technology may have application in creating a sufficiently strong tubular structure for a transport container. Moreover, with the intended use being a transport container, rather than a press fabric where a smooth transition between fabric strips is desired, this is not a particular concern and different joining methods (overlapping and sewing, bonding, stapling, etc.) are possible. Other types of joining may be apparent to one skilled in the art.

It should be noted that U.S. Pat. No. 5,902,070 entitled "Geotextile Container and Method of Producing Same" issued My 11, 1999 and assigned to Bradley Industrial Textiles, Inc. does disclose a helically formed container. Such a container is, however, intended to contain fill and to be stationary rather than a transport container.

It should also be noted that in the papermaking art it is known to create a fabric for use in the papermaking industry having a knitted substrate. In this regard, U.S. Pat. No. 4,948,658 issued Aug. 14, 1990 discloses a fabric which is made from a core filament comprised of a bundle of threads, whose composition may vary, enclosed by a loop thread on a knitting machine. Machine filling threads or yarns transverse the core filament and the loops of the loop threads to create the base fabric. Such a fabric may then be subject to further processing.

Also, it is well known in the papermaking art to create fabric which is impermeable to fluids, a characteristic required for an FFCV. Such fabrics involve a base substrate which may be woven of reinforcing yarns and then impregnated with a suitable resin. Examples of such structures are U.S. Pat. Nos. 6,290,818 B1 and 5,238,537.

With this in mind, the construction or make up of the fabric or tube of the FFCV, whether formed as a single piece or in segments, has to take into account various factors including flexibility, durability, tear and puncture resistance, whilst of course, as aforesaid, being impermeable to sea water. Also, in the absence of flotation devices, the buoyancy of the FFCV, particularly when being emptied and empty is also a consideration. Moreover, the construction or make up of the fabric used should be cost effective. Accordingly, depending upon the application, alternative forms of fabric construction is desirable.

SUMMARY OF THE INVENTION

It is therefore a principal object of the invention to provide for a fabric construction for an FFCV which provides for the various characteristics required.

It is a further object of the invention to provide for a fabric construction for an FFCV which may be readily varied to meet possible changing requirements for the FFCV.

A yet further object of the invention is to provide for a fabric construction which facilitates the coating thereof, or avoids or minimizes the need for the separate coating altogether.

A still further object of the invention is to provide for a fabric construction which is an alternative to a woven fabric.

Accordingly, the present invention is directed towards providing a construction of the fabric used for the tube of an FFCV. In this regard, the fabric is constructed of a number of layers of components, like that of a laminate. The layers may comprise reinforcing components, buoyancy layer or layers, layers that are impermeable or that facilitate later coating, all of which may be bound together by warp knit or stitch bonded binder yarns. The fabric may be made in strips and then assembled into a tube as set forth in U.S. Pat. No. 5,713,399 or in segments and joined together in any number of ways, including that set forth in co-pending U.S. patent application Ser. No. 10/016,640 entitled "Segment Formed Flexible Fluid Containment Vessel" filed contemporaneously herewith which is commonly assigned. In addition, the fabric may be manufactured as a flat roll of cloth and joined endless using either a spiral winding technique, splice or other means suitable for the purpose.

BRIEF DESCRIPTION OF THE DRAWINGS

Thus by the present invention, its objects and advantages will be realized the description of which should be taken in conjunction with the drawings wherein.

DETAILED DESCRIPTION OF THE PREFERRED EMBODIMENT

Figure 1:
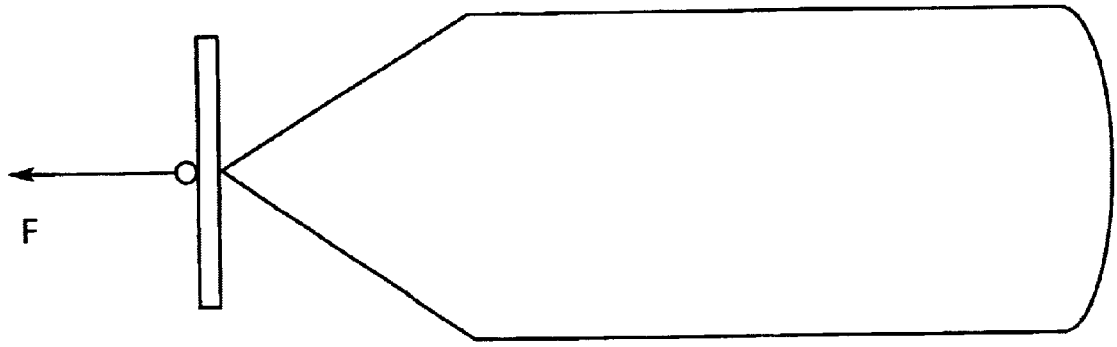
FIG. 1 (PRIOR ART)
FIG. 1 is a somewhat general perspective view of a prior art FFCV which is cylindrical having a pointed bow or nose.
Figure 2:
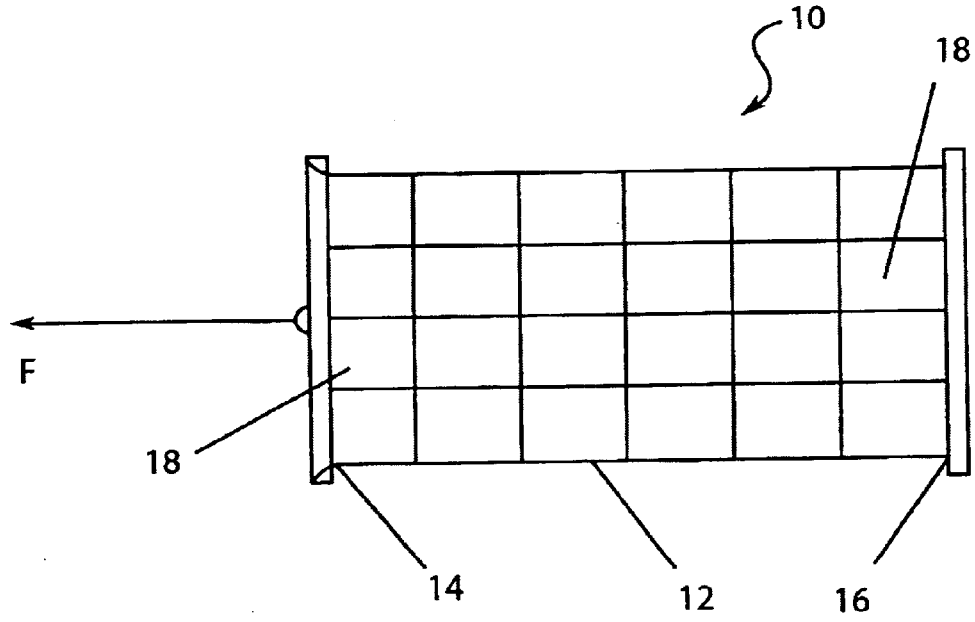
FIG. 2 is a somewhat general perspective view of an FFCV which is formed in segments, incorporating the teachings of the present invention.

The proposed FFCV 10 is intended to be constructed of an impermeable textile tube. The tube's configuration may vary. For example, as shown in FIG. 2, it would comprise a tube 12 having a substantially uniform diameter (perimeter) and sealed on each end 14 and 16. The respective ends 14 and 16 may be closed, pinched, and sealed in any number of ways. A means for loading and unloading cargo (e.g. fresh water) would be provided. The resulting impermeable structure which is fabricated out of segments or strips of material 18 will be flexible enough to be folded or wound up for transportation and storage.

In designing the FFCV to withstand the loads placed thereon, certain factors should be considered. In this regard, in co-pending U.S. patent application Ser. No. 09/832,739 filed Apr. 11, 2001 entitled "Flexible Fluid Containment Vessel" such factors are set forth in detail, along with possible materials for the fabric, their construction and possible coatings and methodology to apply to it to render the fabric impermeable, in addition to other features which may be desirable with regard to the FFCV. Accordingly, further discussion thereof will not be repeated herein rather reference is made to said application.

Also, the present device may have application with regard to the spiral formed FFCV as disclosed in co-pending U.S. patent application Ser. No. 09/908,877 filed Jul. 18, 2001 entitled "Spiral Formed Flexible Fluid Containment Vessel". While there is discussed therein means and methods for joining the wound strips together to form an FFCV, an alternative thereto is disclosed in the aforesaid first mentioned patent application for all or part of the joining process. For example, in high load portions of the FFCV, typically the front and rear, one methodology may be used. For less stressful locations another methodology may be used.

In addition, reference is made to U.S. patent application Ser. No. 09/921,617 filed Aug. 3, 2001 entitled "End Portions for a Flexible Fluid Containment Vessel and a Method of Making the Same" which relates to possible construction of the end portions of the FFCV and U.S. patent application Ser. No. 09/923,936 filed Aug. 7, 2001 entitled "Coating for a Flexible Fluid Containment Vessel and a Method of Making the Same" which discloses additional construction for the fabric, in addition to possible coatings therefor.

The fabric 18 can be that of a patchwork to create the FFCV, wound strip or of other configuration suitable for the purpose. For example, it may be made in segments of flat fabric that has one of its dimensions equal to that of the circumference of the FFCV which is formed into a tube and joined with other so formed segments. The variations are endless.

Figure 3:
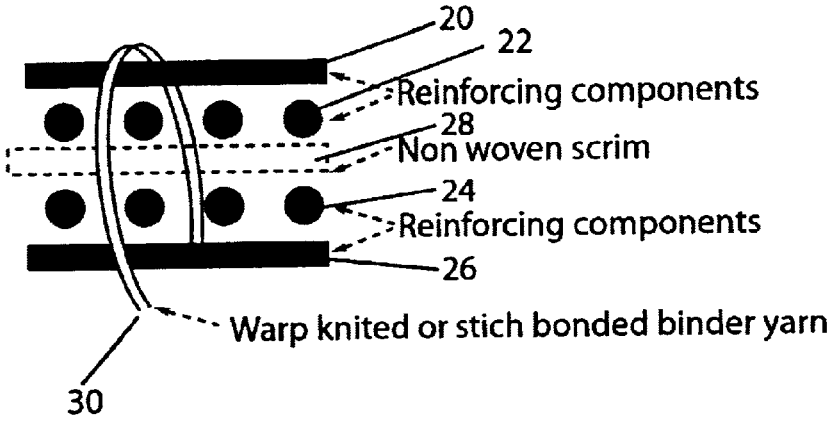
FIG. 3 is a side sectional view of the fabric structure incorporating the teachings of the present invention.

Turning now more particularly to FIG. 3, there is shown the side view of one embodiment of fabric 18. The fabric 18 includes layers 20, 22, 24 and 26 of reinforcing components. These components are typically multifilament or monfilament yarns which may be of the type set forth in the aforesaid applications. Positioned between the reinforcement layers 22–26 is a scrim layer 28. This layer can be woven or non-woven, spun bonded, wet laid or air laid non-woven web, impermeable, semi-impermeable or permeable depending upon how the fabric 18 is to be processed further. For example, as noted in the aforesaid applications, the fabric making up the FFCV must be impermeable to salt water and salt water ions. One of the ways to render the fabric impermeable is to coat it. Suggested coatings and methods of doing it are set forth in certain of the aforesaid application. One of the problems envisioned in coating the fabric is bleed through. In other words, if an endless fabric is coated while laid flat, the coating may pass through the fabric and cause it to stick to the layer of fabric below it. Several methods of avoiding this problem are suggested in the aforesaid applications.

With, however, the present structure of the fabric, the scrim layer 28 can be impermeable at least with regard to the coating being applied. Accordingly, one or both sides of the fabric can be coated without concern for bleed through or sticking. In addition, if the scrim 28 is impermeable to salt water and salt water ions, it might minimize or eliminate the need for coating altogether, since it will act as a barrier. Of course, there may be other reasons for coating as will be later discussed herein.

In addition, the properties of the scrim layer 28 may address other concerns with regard to the FFCV. For example, it is desirable that the FFCV be buoyant when empty so that, for example, it does not sink when empty or otherwise impede the loading and unloading of the cargo. Accordingly, the scrim layer 28 can be made of a buoyant structure or material, for example, it may be made of a reticulated or non-reticulated foam of polyurethane. Other examples in this regard are disclosed in the aforesaid applications Also, the scrim layer 28 may be so formed so as to add structural integrity to the fabric. For example, it may comprise a woven base substrate impregnated with a resin to render it impermeable which is then incorporated as a layer of fabric 18. As to such incorporation, as illustrated in FIG. 3, the reinforcing layers 20–26 and scrim layer 28 are warp knitted or stitch bonded together. Binder yarn 30 is illustrated for this purpose.

Figure 4:
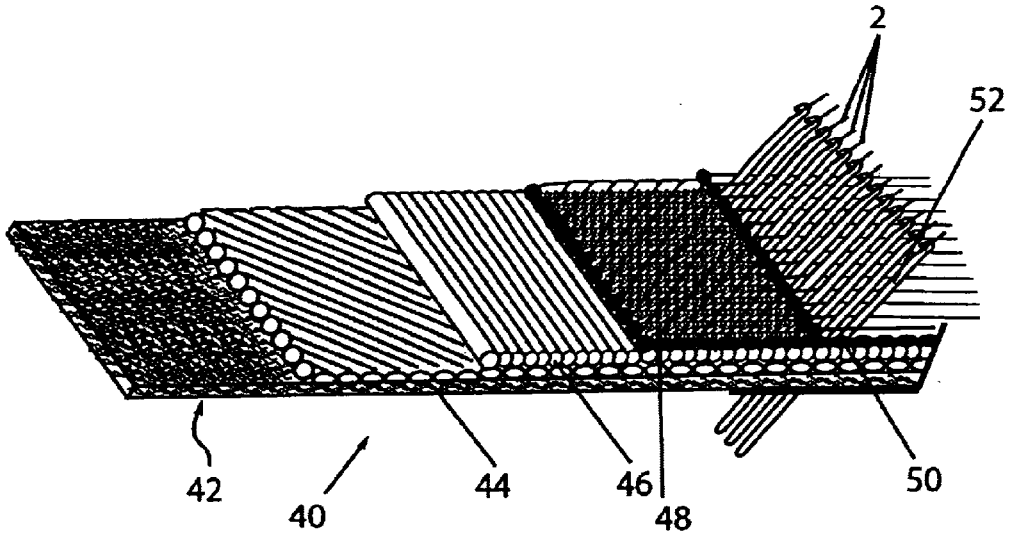
FIG. 4 is a perspective view of the fabric structure incorporating the teachings of the present invention.

Turning now to FIG. 4, there is shown for illustrative purposes a multi-component fabric 40 having layers 42–50 which is being stitch bonded (via binder yarns 52) together. The layers may be woven or non-woven with the scrim layer positioned at the center of the structure or it may comprise any one of the layers. By using a multi-component structure, variations in the design to meet desired characteristics are numerous.

Also, if the structure was not buoyant, it may be desirable to provide a foamed coating on the inside, outside, or both surfaces of the fabric or otherwise coat it in a manner set forth in the aforesaid applications to render the fabric buoyant.

In view of the closed nature of the FFCV, if it is intended to transport fresh water, as part of the coating process of the inside thereof, it may provide for a coating which includes a germicide or a fungicide so as to prevent the occurrence of bacteria or mold or other contaminants.

In addition, since sunlight also has a degradation effect on fabric, the FFCV may include as part of its coating, or the fiber used to make up the fabric, a UV protecting ingredient in this regard.

Although a preferred embodiment has been disclosed and described in detail herein, its scope should not be limited thereby; rather its scope should be determined by that of the appended claims.

What is claimed is:

1. A flexible fluid containment vessel for the transportation of cargo comprising a fluid or fluidisable material, said vessel comprising:

an elongated flexible tubular structure comprised of fabric having a plurality of separate layers formed independently and joined together wherein the fabric further comprises a plurality of reinforcement layers and said layers being joined together by being warp knitted or stitch bonded;

means for rendering said tubular structure impervious;

said tubular structure having a front end and a rear end;

means for sealing said front end and said rear end; and means for filling and emptying said vessel of cargo.

2. A vessel in accordance with claim 1 wherein at least one of said layers is impervious to fluid.

3. A vessel in accordance with claim 2 wherein said fluid is a resin.

4. A vessel in accordance with claim 2 wherein said fluid is salt water.

5. A vessel in accordance with claim 1 wherein said fabric comprises at least one scrim layer.

6. A vessel in accordance with claim 2 wherein said fabric has an inside and an outside and is coated on said inside or outside or both to render the fabric impervious.

7. A vessel in accordance with claim 6 wherein said fabric is formed in segments or strips which are joined together to form said tubular structure.

8. A vessel in accordance with claim 1 wherein the cargo is fresh water.

9. A method of forming a fabric for a tubular structure for a flexible fluid containment vessel for the transportation of cargo comprising a fluid or fluidisable material comprising the steps of:

forming separately at least two layers of material;

joining two layers of material together by warp knitting or stitch bonding; and forming said fabric into the tubular structure; and wherein the formed fabric comprises a plurality of reinforcement layers.

10. The method in accordance with claim 9 wherein at least one layer is impermeable to fluid.

11. The method in accordance with claim 10 wherein said fluid is a resin.

12. The method in accordance with claim 10 wherein said fluid is salt water.

13. The method in accordance with claim 9 wherein said fabric comprises at least one scrim layer.

14. The method in accordance with claim 13 which includes the step of coating the fabric on a first side or a second side or both to render the fabric impervious.

15. The method in accordance with claim 9 which includes the step of forming said fabric in segments or strips and joining the segments or strips together to create the tubular structure.

16. The method in accordance with claim 9 which includes the step of using said vessel for the transportation of fresh water.

* * * * *